US006694525B1

(12) United States Patent
Murnan

(10) Patent No.: US 6,694,525 B1
(45) Date of Patent: Feb. 24, 2004

(54) ADJUSTABLE CONFIGURABLE HEADWEAR

(76) Inventor: Tad Wetherill Murnan, 45 Hulbert Ave., Nantucket, MA (US) 02554

( * ) Notice: Subject to any disclaimer, the term of this patent is extended or adjusted under 35 U.S.C. 154(b) by 0 days.

(21) Appl. No.: 10/222,586

(22) Filed: Aug. 15, 2002

Related U.S. Application Data

(60) Provisional application No. 60/312,643, filed on Aug. 15, 2001.

(51) Int. Cl.[7] ..... A42B 1/22; A61F 9/00

(52) U.S. Cl. ..... 2/183; 2/12; 2/195.2; 2/421; 2/918; 2/DIG. 11

(58) Field of Search ..... 2/10, 12, DIG. 11, 2/183, 421, 175.6, 195.2, 909, 918, 171.1

(56) References Cited

U.S. PATENT DOCUMENTS

| | | | | |
|---|---|---|---|---|
| 4,023,212 A | | 5/1977 | Huffman | |
| 4,873,726 A | | 10/1989 | Tapia | |
| 5,046,196 A | * | 9/1991 | Sullivan | 2/918 |
| 5,070,545 A | | 12/1991 | Tapia | |
| 5,091,994 A | * | 3/1992 | Delane et al. | 2/195.1 |
| 5,091,995 A | | 3/1992 | Oates | |
| 5,099,524 A | | 3/1992 | Linday | |
| 5,105,476 A | | 4/1992 | Cox | |
| 5,406,645 A | | 4/1995 | Lin | |
| 5,437,062 A | | 8/1995 | Douglas | |
| 5,613,246 A | | 3/1997 | Alexander | |
| 5,685,017 A | | 11/1997 | Kraft | |
| 5,694,647 A | | 12/1997 | Crickmore | |
| 5,845,338 A | | 12/1998 | Clark | |
| 5,862,520 A | | 1/1999 | Wyant | |
| 5,875,493 A | | 3/1999 | MacDonald et al. | |
| 5,896,587 A | * | 4/1999 | Gentry | 2/12 |
| 5,901,370 A | | 5/1999 | Linday | |
| 6,560,780 B2 | * | 5/2003 | Zar | 2/12 |

FOREIGN PATENT DOCUMENTS

| | | | |
|---|---|---|---|
| FR | 1259571 A | * | 3/1960 |
| GB | 2039725 A | * | 8/1980 |

* cited by examiner

*Primary Examiner*—Rodney M. Lindsey
(74) *Attorney, Agent, or Firm*—Fish & Richardson P.C.

(57) ABSTRACT

An article of headwear that is adjustable to accommodate a wide range of head sizes comprising a front portion having a partial headband with bring and a rear portion having a partial headband with brim, wherein said partial headbands may be overlapped for size adjustment and detachably secured by means of cooperating VELCRO strips. Optional additional components include extension headband strips for further size enlargement, a crown, side flaps and a chin strap, all of which can be detachably secured to the front and rear portions by VELCRO fasteners.

18 Claims, 11 Drawing Sheets

ADJUSTABLE CONFIGURABLE HEADWEAR

CROSS REFERENCE TO RELATED APPLICATIONS

This application claims the benefit of prior U.S. provisional application Ser. No. 60/312,643, filed Aug. 15, 2001.

TECHNICAL FIELD

This invention relates to hats having brims and more particularly to hats that are adjustable to fit heads of different sizes.

BACKGROUND

Hats with brims, such as the ubiquitous "baseball cap" are well know. Adjustability to head size is commonly achieved by means of a split headband whose ends can be overlapped to varying extent. To accommodate adjustment of the headband, a portion of the rear panel or area of the crown is omitted such that the crown can change shape. Hats with both front and rear brims are also known as are visors comprising a headband and a brim without a crown portion. Size adjustment of hats with adjustable headbands is limited in range due to the design.

An aspect of this invention is an adjustable article of headwear comprising a front portion having a partial front headband having rearwardly extending ends and a front brim depending and extending outwardly therefrom, and a rear portion having a partial rear headband having forwardly extending ends and a rear brim depending therefrom and extending outwardly therefrom, said ends being overlappable to a variable extent for size adjustment, wherein the ends of at least one of said partial headbands includes an outer VELCRO hooks material and at least the ends of the other of said partial headbands includes an inner VELCRO loops material, whereby the said front and rear partial headbands can be overlapped and detachably secured to form a continuous headband of desired circumference.

Another aspect of this invention is an adjustable article of headwear comprising a front brim, optionally with a headband, having rearwardly extending sides, and a rear brim, optionally with a headband, having forwardly extending sides, a pair of patches of VELCRO hooks material on the underside of at least a first of said brims' extending sides, and a pair of patches of VELCRO loops material on the upper side of at least the other of said brims' extending sides, whereby said front and rear brims can be overlapped to a variable extent for size adjustment and detachably secured to one another by engagement of said patches.

Further aspects of this invention are to provide an article that is configurable by the user with at least one detachable component selected from the group of extension links, side panels, a crown, an extension brim, and a chin strap.

These and other objects will be apparent from the description which follows, together with the drawings.

SUMMARY

This invention comprises an article of headwear comprising front and rear brims and usually a headband, that is either a crownless, visor construction or a crowned, hat construction. Headwear according to this invention minimally includes at least a front portion and a rear portion. In preferred embodiments each portion is of visor-like construction, comprising a flexible, comfortable partial headband extending partially around the sides of the wearer's head and a stiff but deformable brim for protection from the sun projecting outwardly from the bottom of the band. Each brim may also extend around the sides of the wearer's head. Size adjustment is achieved by adjusting the overlap of a spacing between, the front and rear portions. In some embodiments the user forms a double-brimmed article of headwear by overlapping the partial headbands and detachably securing them together. In other embodiments the user forms a double-brimmed article of headwear by overlapping the brim side extensions and detachably securing them together. Size adjustment is achieved by varying the amount of overlap. Attachment is preferably by means of VELCRO hook-and-loop detachably securing strips. When securing is by means of partial headbands, a hooks strip or strips, which would be uncomfortable against the wearers head, is placed on the outside of the headband of one portion, preferably the front portion, and a soft loops strip or strips is placed on the inside of the other band. Unlike certain adjustable visors that have only partial headbands, there is no need to have the brim side portions inwardly biased to secure the article to the head. Once the front and rear portions are secured to one another there is formed a fully circumferential headband. In certain embodiments extension headband links are also provided. The links are headband strips having attachment means, preferably VELCRO hooks material on the side facing away from the user's head. Each of the front and rear portions may include a partial headband with a soft VELCRO loops strip on the insides of its termini. Detachably securing extension links extending from the front portion to the rear portion enlarges the range of size adjustment of the headwear, enabling it, for example, to be worn over a motorcycle or other helmet.

Embodiments of the invention include one or more additional detachable components. One such component is an adjustable, detachable crown. For addition of this component both headbands of the front and rear portions are provided with outwardly facing strip or strips of VELCRO hooks material that form a continuous, or nearly continuous, band around the assembled article. The adjustable crown is constructed similarly to a typical adjustable baseball cap or golf cap minus a brim. It has a lower band dissected at the rear and has a rear portion of the crown material omitted to permit size adjustment. In this case the lower band, including the overlappable extensions, if any, has on its inner surface a strip or strips of VELCRO loops material for detachably securing the crown to outside of the continuous headband formed by the front and rear portions and, if utilized, the extension links.

Another detachable component is side panels for protecting the sides of the wearer's head and neck. The side panels are preferably of flexible material so that they hang down. For addition of this component, the brims of the first and second portions are provided on their upper sides with attachment strips of VELCRO loops material, and the side panels are provided along the inside of one straightedge with a strip of VELCRO hooks material.

Another detachable component is an overlapping brim extension to provide increased shade and protection. A brim extension is a piece of brim material. It is attached onto the brim of either the front portion or the rear portion by providing the upper surface thereof with at least one, preferably at least two, strip(s) of VELCRO loops material and providing the underside of the overlapping brim extension with a corresponding strip or strips of VELCRO hooks material.

Another detachable component is a chin strap, which can be detachably secured between the overlapped partial headbands of the front and rear portions by providing the ends of the chin strap with a strip of VELCRO hooks material on one side and VELCRO loops material on the other side. The chin strap can be one-piece, or it can be two-piece, with attachment means, preferably adjustable, under the chin. For adjustment, I prefer a strip of VELCRO hooks material on the outside of the lower end of one piece and a strip of VELCRO loops material on the inside of the lower end of the other piece.

The details of one or more embodiments of the invention are set forth in the accompanying drawings and the description below. Other features, objects, and advantages of the invention will be apparent from the description and drawings, and from the appended claims.

DESCRIPTION OF DRAWINGS

Like reference symbols in the various drawings indicate like elements.

DETAILED DESCRIPTION

Figure 1:
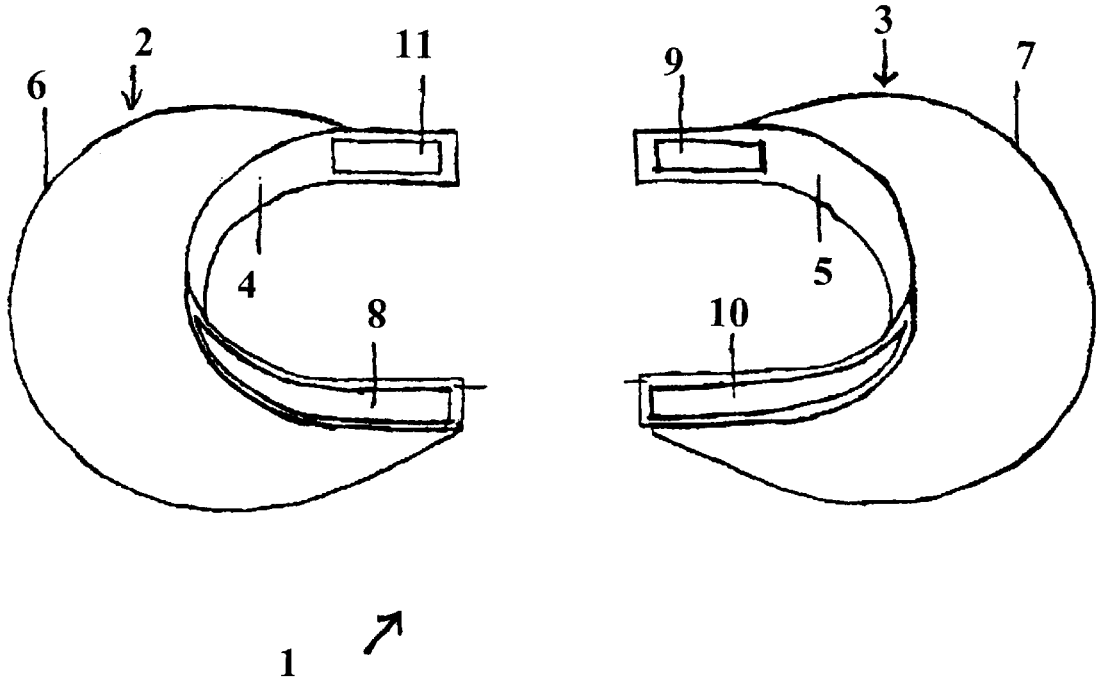
FIG. 1 is a perspective view of the front portion and rear portion of a visor-type embodiment of this invention shown detached.

FIG. 1 shows a preferred embodiment of the basic article of headwear according to this invention in its detached form Headwear article 1 comprises front portion 2 and rear portion 3. Front portion 2 comprises partial headband 4 and brim 6. Disposed on the inside face of partial headband 4 are strips of VELCRO loops material 11 (one shown), placed on both rearward-facing ends of the partial headband. Disposed on the outside face of partial headband 4 is a strip of VELCRO hooks material 8. Rear portion 3 comprises partial headband 5 and brim 7. Disposed on the inside of partial headband 5 are strips of VELCRO loops material 9 (one shown), placed on both forward-facing ends of the partial headband. Disposed on the outside face of partial headband 5 is a strip of VELCRO hooks material 10.

The embodiment shown in FIG. 1 is adapted for alternative assembly by overlapping headbands 4, 5 with either partial headband outside the other. The embodiment shown in FIG. 1 is further adapted for attachment of a crown piece and extension links. A simpler embodiment, a double-brimmed visor, could eliminate one strip of VELCRO hooks material, for example, strip 8; eliminate one set of VELCRO loops material, for example, strips 9; and for the remaining strip of VELCRO hooks material, for example strip 10, eliminate the central portion not needed for assembly of portions 2, 3.

Figure 2:
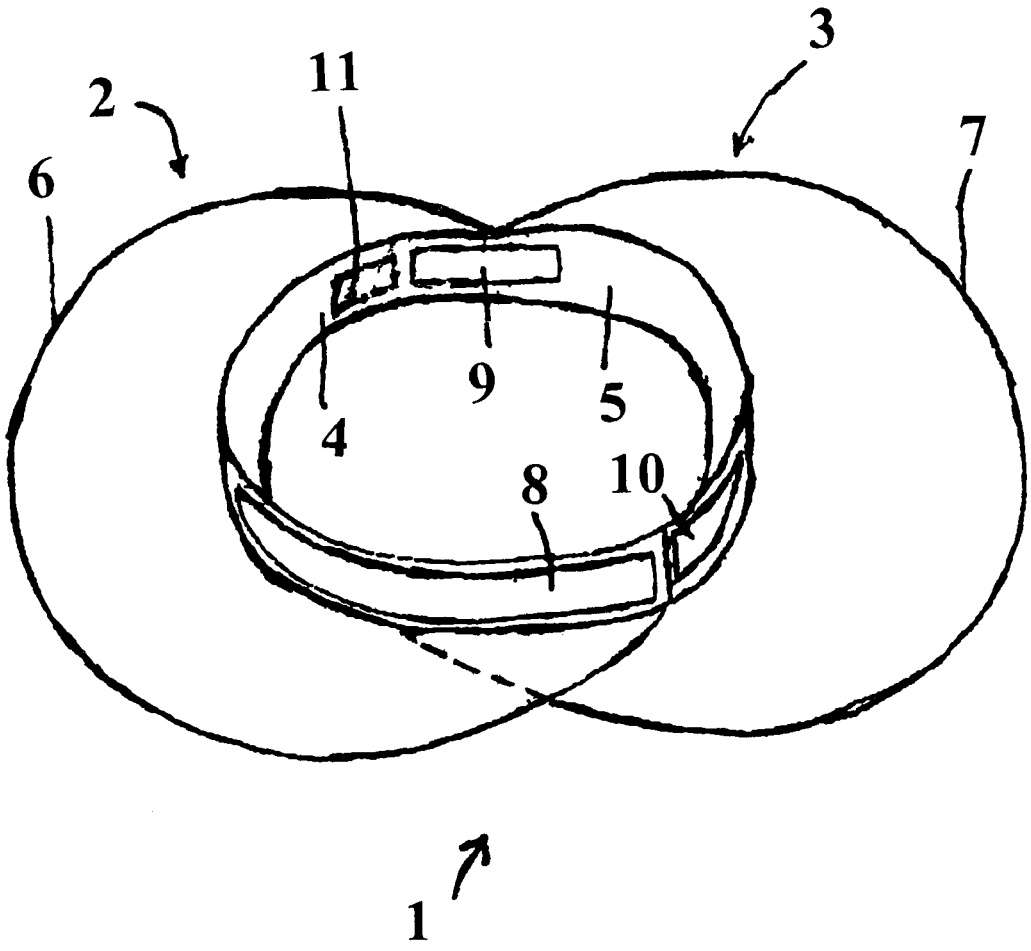
FIG. 2 is a perspective view of the embodiment of FIG. 1, shown in assembled configuration.

FIG. 2 shows the embodiment of FIG. 1 in its assembled form. Article 1 is assembled by overlapping portions 2, 3 with the partial headband 4 of front portion 2 outside partial headband 5 of rear portion 3, forming a continuous headband whose size is adjusted by changing the amount of overlap. Portions 2, 3 are detachably secured to one another by the interaction of VELCRO loops 11 with VELCRO hooks 10. This is my preferred manner of assembly. As noted above, however, the depicted embodiment is versatile and can be assembled in the opposite fashion, with partial headband 5 outside partial headband 4 (or even with partial headband 5 on the outsides on one side of the user's head but on the inside on the other side of the user's head. The simpler embodiment described above can utilize either my preferred manner of assembly or the opposite.

Brims 6, 7 extend not only across the front and rear of portions 2, 3, but further extend along the sides and are approximately coterminal with headbands 4, 5. Overlapping partial headbands 4, 5 also overlaps brims 6, 7. In other embodiments brims 6, 7 are not coterminal with partial headbands 4, 5, and generally do not overlap in the assembled article 1.

Shown disposed on the inside of partial headband 4 are optional strips of VELCRO loops material 11 (one shown), placed on both rearward-facing ends of the partial headband. These strips are used for attachment of extension links, discussed below, as well as to enable alternative assembly.

Figure 3:
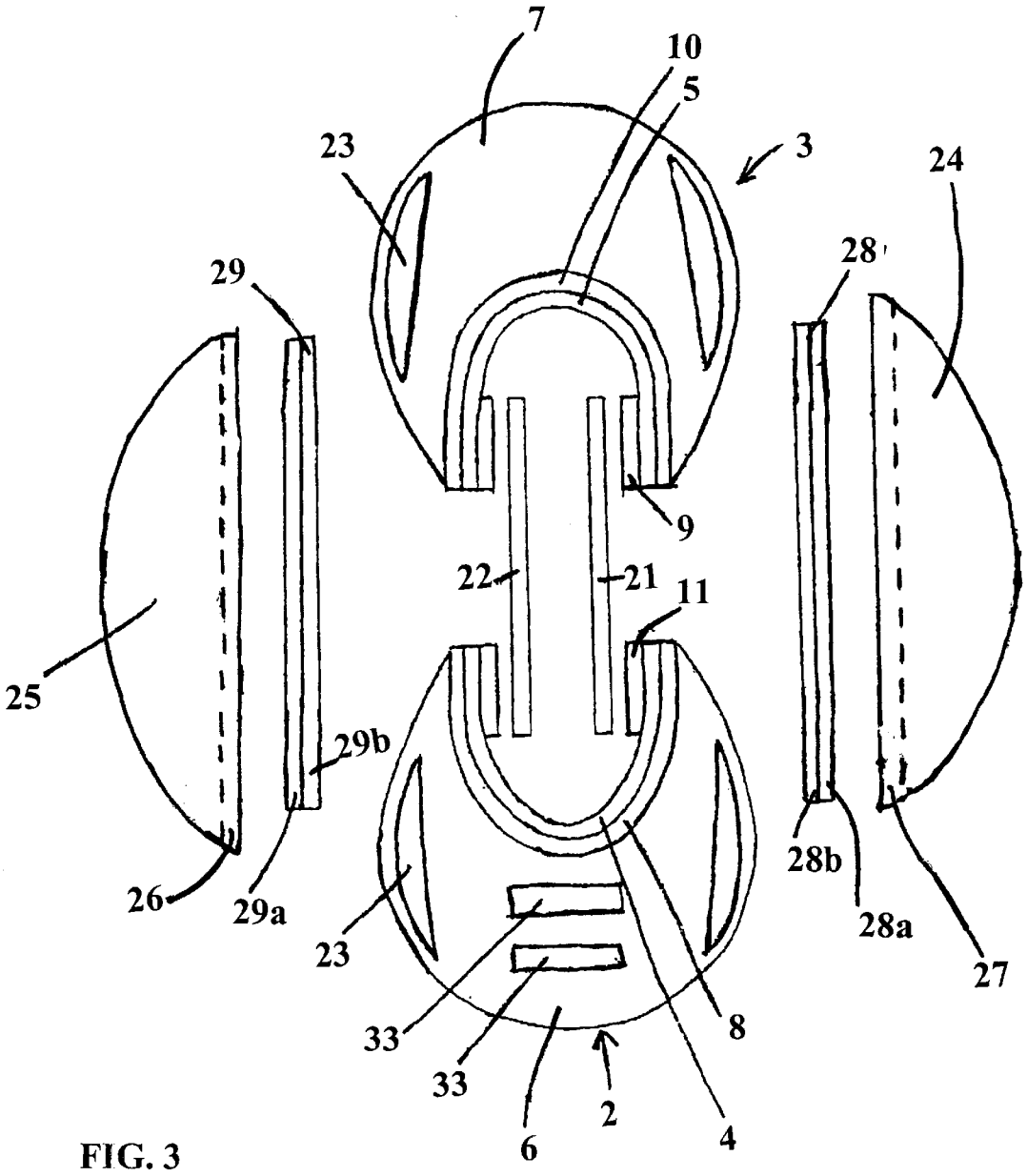
FIG. 3 is an exploded top view of the front and rear portions showing additionally extension links, side flaps and bridging strips.

Turning to FIG. 3, there is shown an embodiment of front and rear portions 2, 3 with additional components. Extension headband links may be used to extend the range of adjustment of the size of the article. I prefer to use a pair of extension links on each side of article 1. Shown in FIG. 3 are a pair of links 21, 28 for one side of a pair of links 22, 29 for the opposite side. Each of inside links 21, 22 is a material strip having outward-facing VELCRO hooks material for engagement with strips 9, 11 of VELCRO loops material. Each of outside links 28, 29 is a material strip having inward-facing VELCRO loops material **28*b*, 29*b* for engagement with strips 8, 10 of VELCRO hooks material on the outside of brims 4, 5 and in their central regions with the VELCRO hooks material of inside links 21, 22. Strips 28, 29 additionally have outward-facing VELCRO hooks material 28*a*, 29*a*** for attachment of a crown, discussed below.

Placed on the upper sides of brims 6, 7, extending rearwardly along the brim sides are strips of VELCRO loops material 23. To these strips can be attached side panels 24, 25, which are provided with strips 26, 27 of VELCRO hooks material on their under sides.

Figure 4:
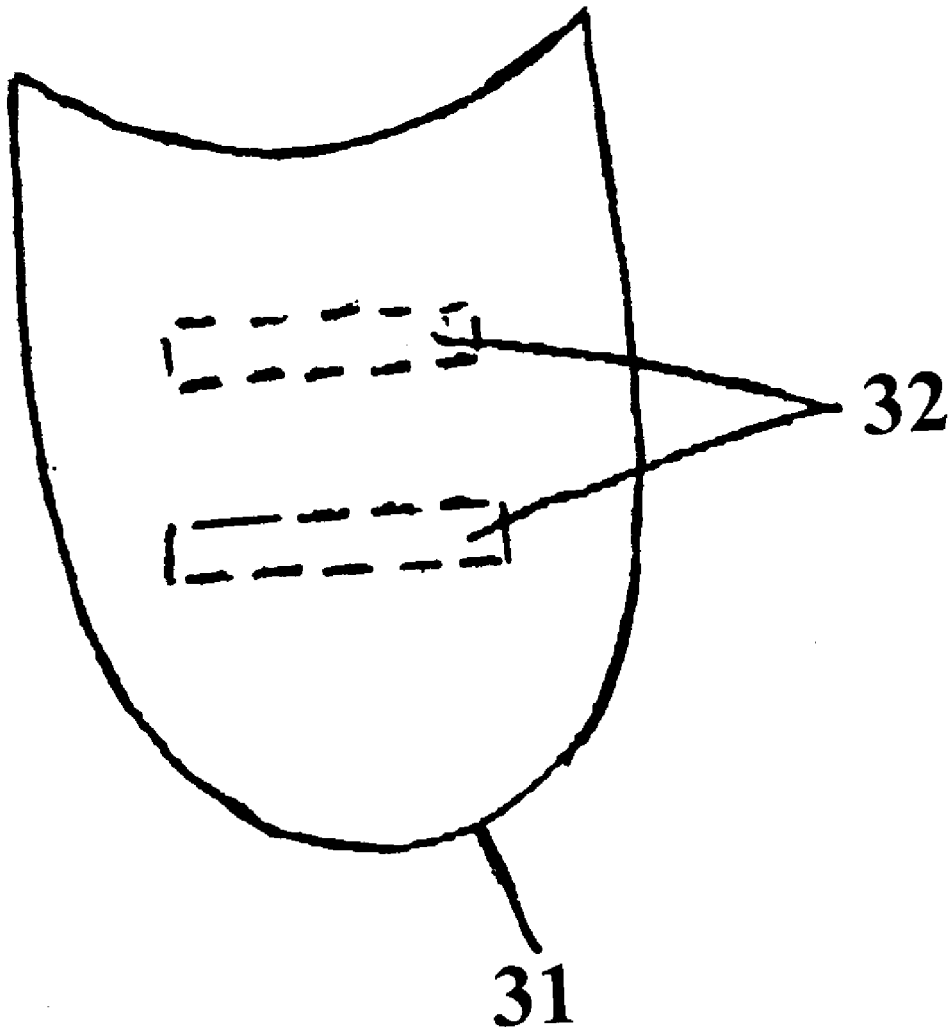
FIG. 4 is a top view of a brim extension.

Shown in FIG. 4 is one brim extension 31 having a pair of strips of VELCRO hooks material 32 on its underside. Placed on the top surface of brim 6 (FIG. 3) are a pair of corresponding strips of VELCRO loops material 33, for attachment of the extension to the brim. A second brim extension for the other brim can be attached in like fashion.

Figure 5:
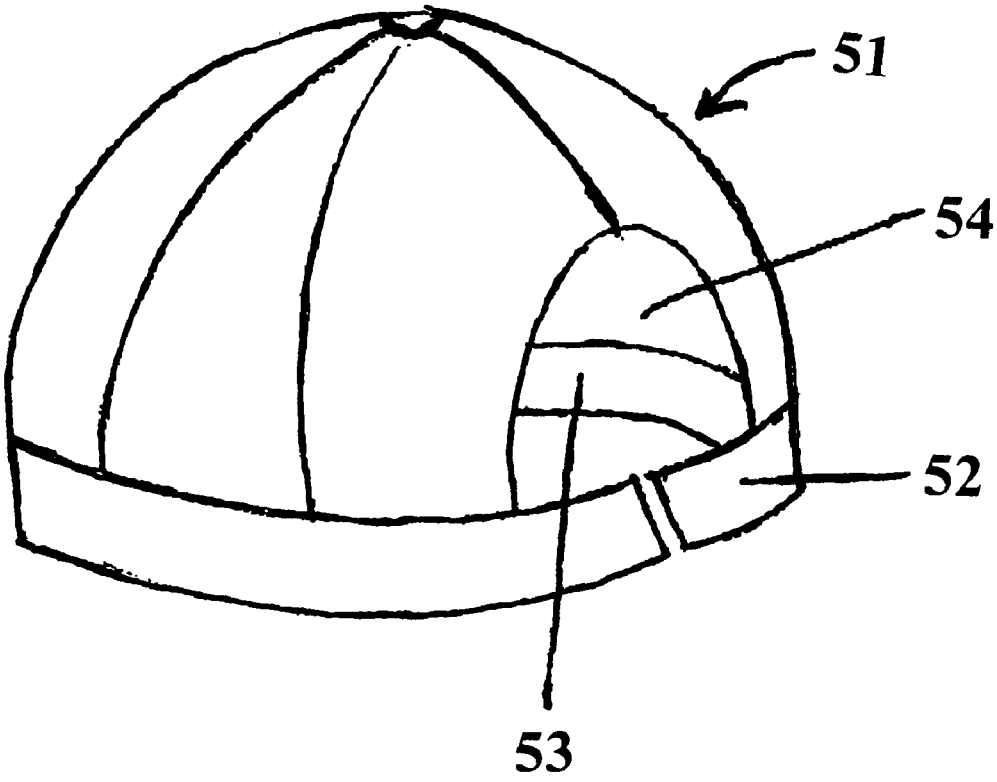
FIG. 5 is a perspective view of an embodiment of a crown module.

FIG. 5 shows an adjustable crown 51 that can be detachably secured to the headwear article to form a hat. Crown 51 is constructed similarly to an adjustable baseball cap or golf cap, but without a brim. It comprises a basically hemispherically shaped structure of flexible material that is open along its generally circular lower periphery, along which is a split band 52 that provides some size adjustment. Open area 54 is provided to accommodate size changes. The inside of peripheral band 52 is VELCRO loops material 53, whereby crown 51 can be detachably secured to external VELCRO hooks material on the outside of the detachable secured partial headbands 5, 6 (FIG. 2) or on the outside of the assembled partial headbands 5, 6 and extension links 28, 29 (FIG. 3).

Figure 6:
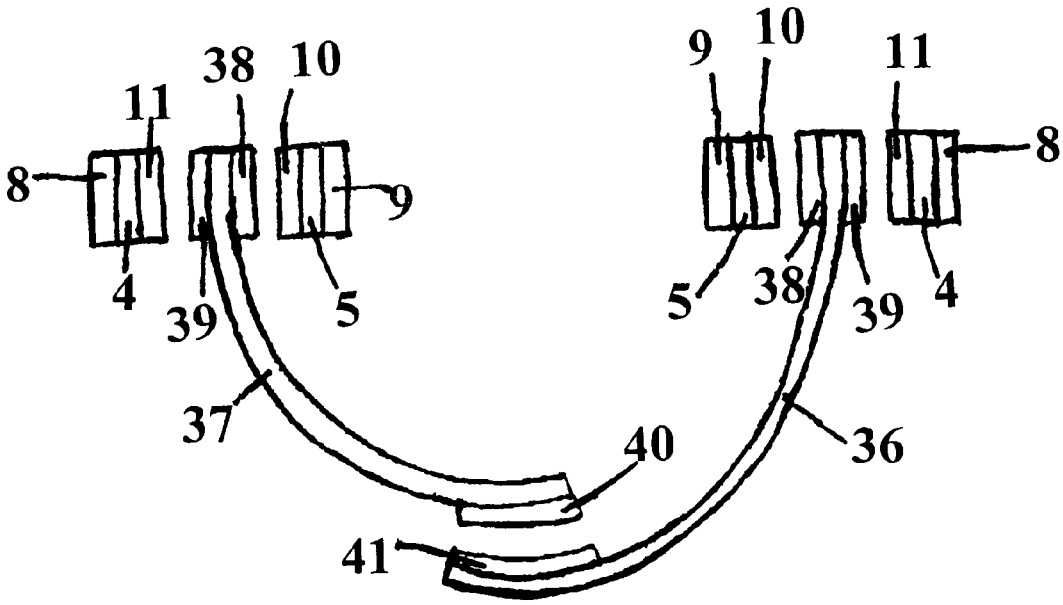
FIG. 6 is a side view of a section of overlapped front and rear portions taken through their overlapped partial headbands showing a detachable chin strap.

FIG. 6 shows insertion of a two-piece chin strap 36, 37 between overlapped headband portions 4, 5. Each chin strap portion has an upper terminal end having a strip of VELCRO loops material 38 on the inside for engagement with hooks strip 10 on the outside of headband portion 5 and having a strip of VELCRO hooks material 39 on the outside for engagement with loops strip 11 on the inside of the headband portion 4. The bottom terminal ends of strap portions 36, 37 are provided with adjustable fastening means. Any conventional means can be used but I prefer an outwardly facing VELCRO hooks strip 40 on the strap and an inwardly facing VELCRO loops strip 41 on the other strap.

Figure 7:
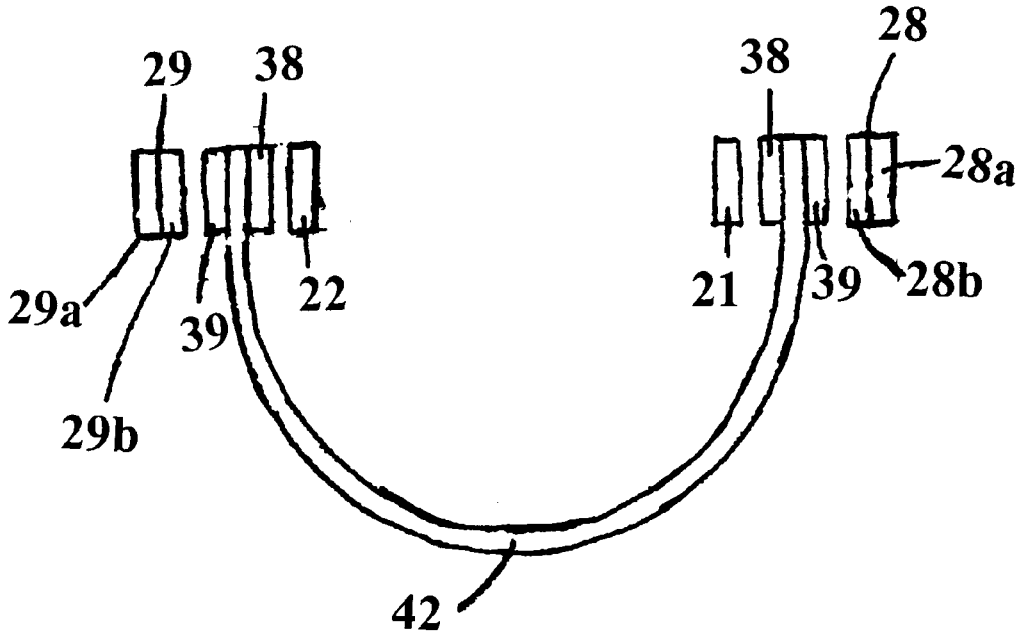
FIG. 7 is a side view of a section of front and rear portions assembled through extension links, taken through said links, showing a detachable chin strap.

FIG. 7 shows insertion of a one-piece chin strap 42 between the inner and outer extension links shown in FIG. 3. Here again each end of the chin strap has a strip of VELCRO loops material 38 on the inside and VELCRO hooks material 39 on the outside. Chin strap 42 is sandwiched between VELCRO hooks material of inner extension links 21, 22 and VELCRO loops material 28*b*, 29*b* of outer extension links 28, 29. It will be appreciated that if only one extension link for each side is provided, for example outer links 28, 29, only the corresponding attachment means would be needed for strap 42, for example strips 39.

Figure 8:
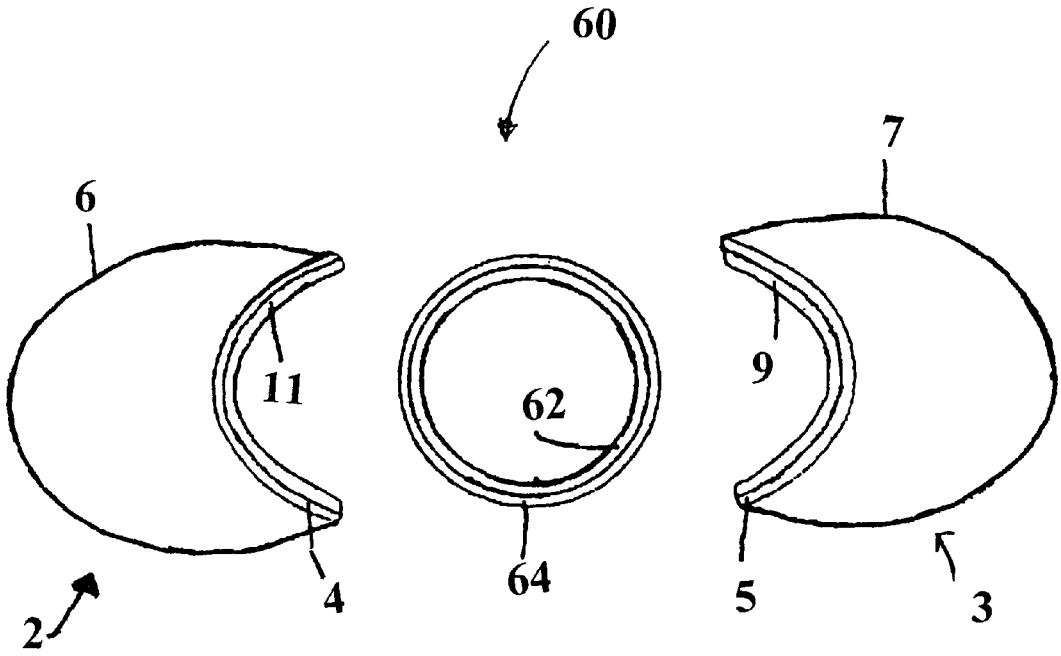
FIG. 8 is a plan view of an embodiment of the invention in which a helmet is placed intermediate visor portions and detachably secured thereto.

Particularly by utilizing extension links, article 1 can be expanded to fit over a helmet, for example, a motorcycle helmet or a bicycle helmet. Additionally, a helmet can be adapted to interact with front and rear portions 2, 3. FIG. 8 shows a helmet 62 provided with a circumferential ring of VELCRO hooks material 64, which can be engaged by partial headbands 4, 5 through their inward facing VELCRO loops material 9, 11 to provide an assembled article 60. Helmet 62 itself provides a continuous headband for the assembled article 60. Thus, it is not required that portions 2, 3 overlap, as the VELCRO ring on the helmet serves as extension links. For some uses, one may wish to add outer extension links 28, 29 for enhanced stability.

Figure 9:
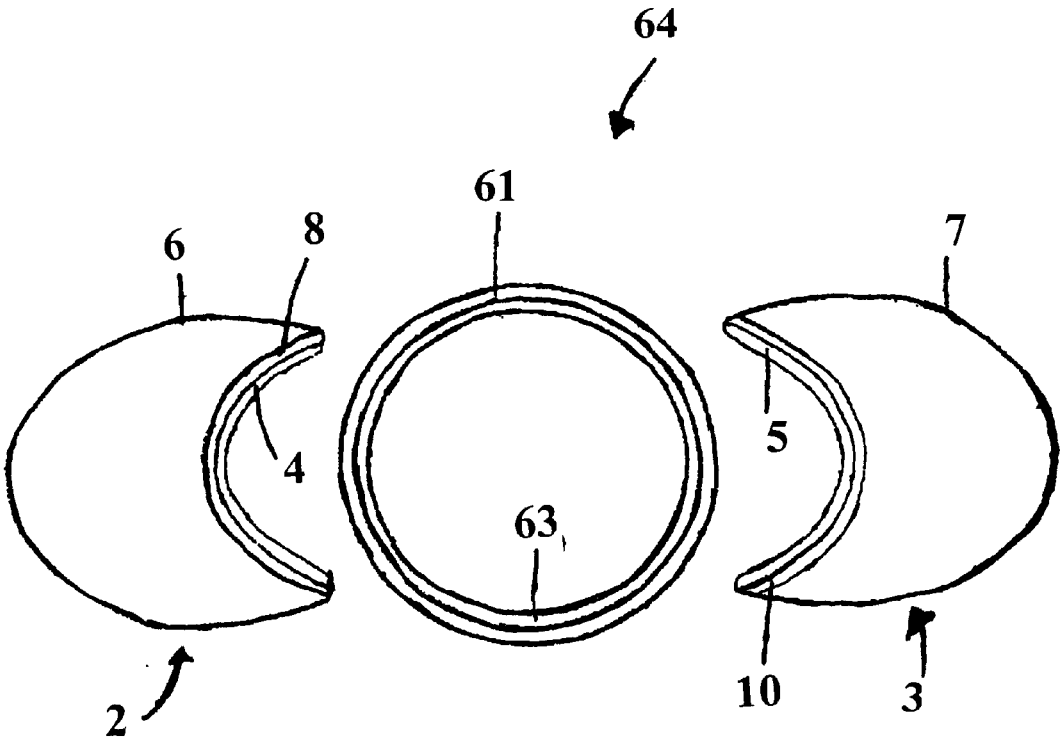
FIG. 9 is a plan view of an embodiment of the invention in which visor portions are secured inside a helmet.

FIG. 9 shows alterative helmet embodiment. Helmet 61 is provided with an inner circumferential ring of VELCRO loops material 63. Partial headbands 4, 5 of front and rear portions 2, 3 can be placed inside the helmet such that outward facing VELCRO hooks material 8, 10 engages ring 63 to provide an assembled article 64. As with article 60 of FIG. 8, the helmet provides a continuous headband and can serve as extension links. For some uses, one might wish to add inner extension links 21, 22 for enhanced stability.

In the embodiments shown in FIG. 8 and FIG. 9, one of front and rear portions 2, 3 can be omitted from the assembly. There will still be a complete headband, as noted above. In helmet-less embodiments such as shown in FIG. 1, one of front and rear portions can also be omitted from the assembly. In this case, however, a strap substituting for omitted headband is needed. Referring to FIG. 1, if rear portion 3 is omitted, a strap having VELCRO loops on one side, to be faced inwardly in the fashion of strips 9, would be substituted for headband 5 to join the open ends of headband 4. It will be appreciated that two such straps will permit each of portions 2, 3 to be used individually.

Figure 10:
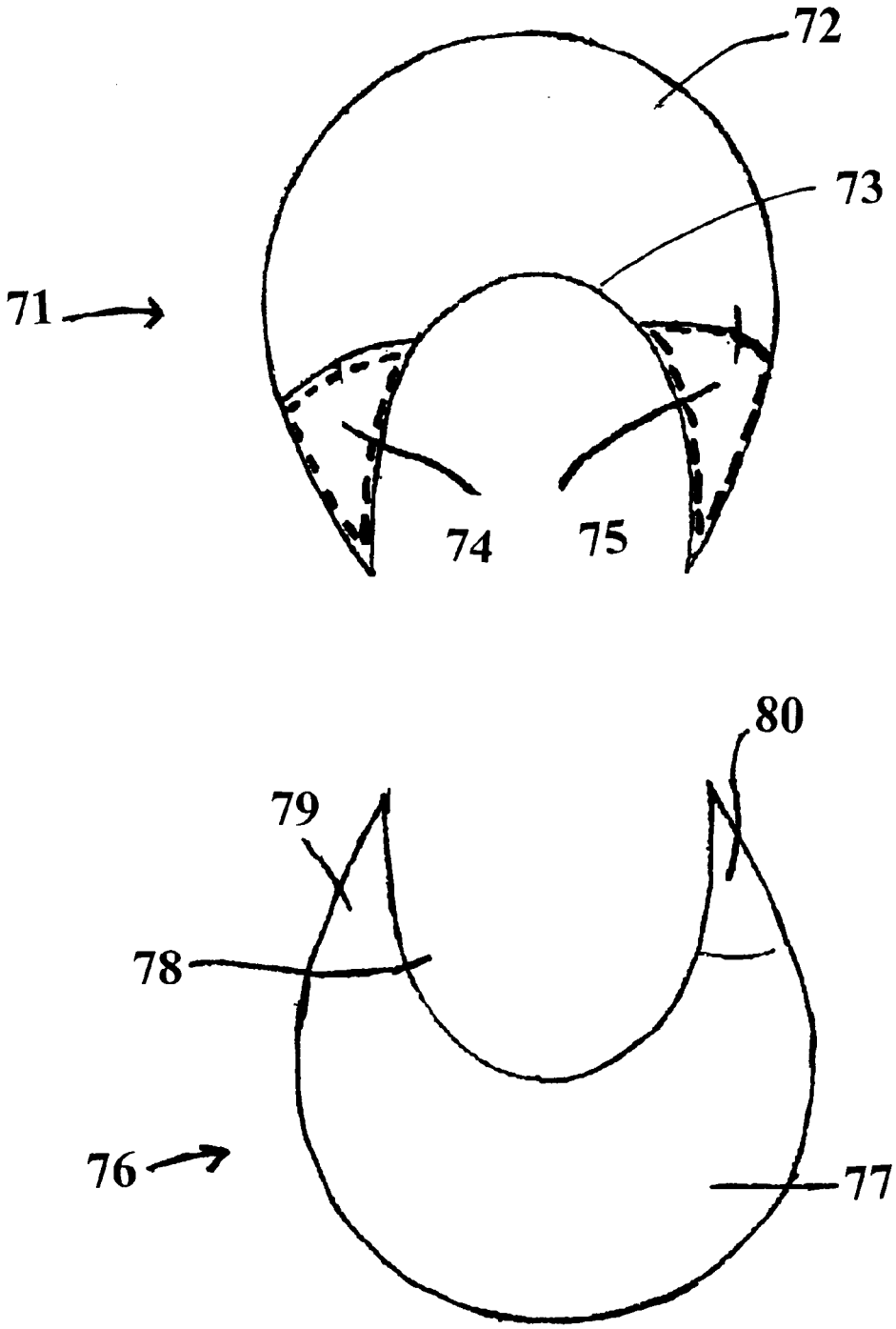
FIG. 10 is a top view of an alternative embodiment of the front portion and rear portion of a visor of this invention, shown detached.
Figure 11:
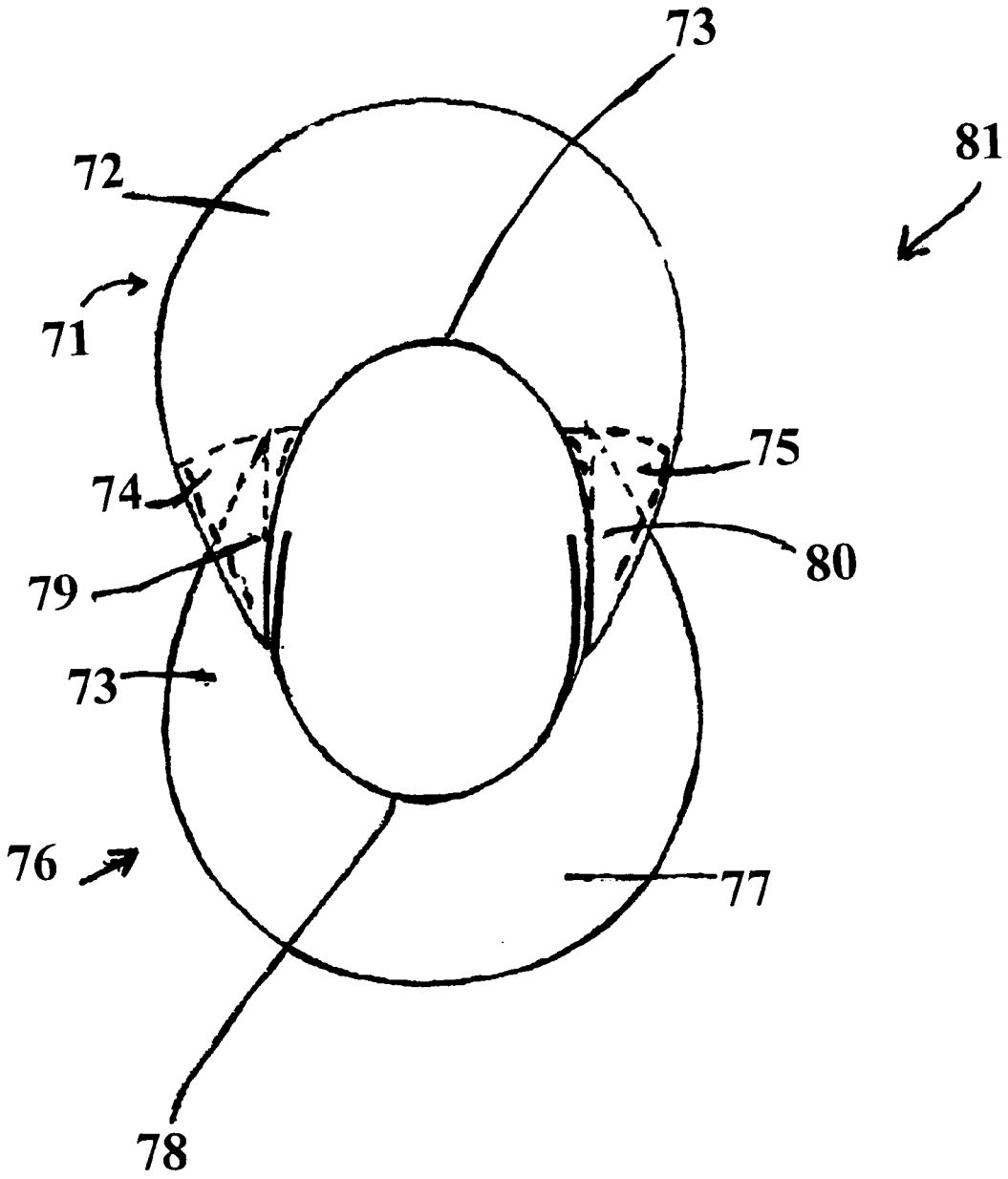
FIG. 11 is a top view of the embodiment of FIG. 10 shown in assembled configuration.

FIG. 10 shows yet another embodiment of the invention showing an alternative way to detachably secure front and rear portions. Front portion 71 includes brim 72 and partial headband 73. On the rearwardly extending sides of brim 72 are patches 74, 75 of VELCRO hooks material on the underside of the brim. Rear portion 76 includes brim 77 and partial headband 78. On the forwardly extending sides of brim 77 are patches 79, 80 of VELCRO loops material on the upper side of the brim. FIG. 11 shows the embodiments of FIG. 10 as assembled. Front portion 71 overlaps rear portion 76 such that patches 74, 75 are detachably secured to patches 79, 80. As depicted partial headband 73 overlaps partial headband 78 to the outside. A variant of this embodiment is to provide both of brims 72, 77 with patches of VELCRO hooks material on their undersides and patches of VELCRO loops material on their upper sides, so that either may be placed on the other. In the embodiment depicted in FIG. 10 and FIG. 11 partial headbands 73, 78 are not utilized to detachably secure portions 71, 76. Accordingly, one could eliminate all or a portion of either headband.

It will be appreciated that some or all aspects of previously described embodiments can be incorporated in the embodiment of FIG. 10 and FIG. 11. For example, partial headbands 4, 5 (FIG. 1) could be substituted for partial headbands 73, 78, and the additional components of a crown (FIG. 5), a chin strap (FIG. 6), or extension brims (FIG. 4), or side flaps (FIG. 3) could be added. An alternative construction would be to sandwich a chin strap such as 36, 37 (FIG. 6) between patches 74, 79 on one side and between patches 75, 80 on the other side.

A number of embodiments of the invention have been described. Nevertheless, it will be understood that various modifications may be made without departing from the spirit and scope of the invention. Accordingly, other embodiments are within the scope of the following claims.

What is claimed is:

1. An adjustable double-brimmed article of headwear comprising a front portion having a partial front headband having rearwardly extending ends and a front brim depending and extending outwardly therefrom, and a rear portion having a partial rear headband having forwardly extending ends and a rear brim depending therefrom and extending outwardly therefrom, said ends being overlappable to a variable extent for size adjustment, wherein the ends of at least one of said partial headbands includes an outer hooks material and at least the ends of the other of said partial headbands includes an inner loops material, whereby the said front and rear partial headbands can be overlapped and detachably secured to form a continuous headband of desired circumference.

2. The article of claim 1 wherein the ends of both said partial front headband and said partial rear headband include outer hooks material and inner loops material.

3. The article of claim 1 further comprising strips of loops material on an upper surface of sides of said brims and detachably securable thereto a pair of flexible side panels each having an edge strip of hooks material.

4. The article of claim 1 wherein both partial headbands have outer hooks material, further comprising an adjustable flexible crown having an open lower periphery and having a strip of loops material on its inside along said periphery and detachably securable to the outer hooks material of said partial headbands.

5. The article of claim 1 further comprising a chin strap having ends, said ends having loops material on one side and hooks material on the other side, said chin strap ends being detachably securable between said partial headbands when they are overlapped.

6. The article of claim 5 wherein said chin strap is a two-piece strap whose pieces are adjustably and detachably securable to one another.

7. The article of claim 1 wherein at least one of said front and rear brims has on its upper surface patches of loops material, further comprising at least one extension brim having an underside that includes patches of hooks material, whereby said at least one extension brim is detachably securable to said at least one brim.

8. The article according to claim 1 wherein the ends of both partial headbands include inner loops material, further comprising two pairs of headband extension links, each pair comprising a first material strip having hooks material on one side and a second material strip having hooks material on one side and loops material on its other side, whereby said strips can be overlapped to a variable extent with said partial front and partial rear headbands and detachably secured thereto to form an enlarged continuous headband of desired circumference.

9. The article according to claim 8 further comprising a chin strap having ends, said ends having hooks material on one side and loops material on the other side, whereby said chin strap is detachably securable between each pair of said extension links.

10. The article according to claim 8 wherein both partial headbands have outer hooks material, further comprising an adjustable flexible crown having an open lower periphery having a strip of loops material on its inside along said periphery and detachably securable to the outer hooks material of said partial headbands and said headband extension links.

11. The article according to claim 8 wherein each of said front brim and said rear brim has sides depending from and extending outwardly from said rearwardly and frontwardly extending partial headband ends, further comprising strips of loops material on the upper surface of said sides, and detachably securable thereto a pair of flexible side panels each having an edge strip of hooks material.

12. The article according to claim 8 in combination with a helmet having a circumferential strip of hooks material, whereby said front and rear partial headbands can be detachably secured to said circumferential strip.

13. The article of claim 12 further comprising two headband extension links having loops material on one side, whereby said links can be overlapped with outer hooks material on the ends of said partial headbands.

14. The article of claim 1 in combination with a helmet having an inner circumferentially disposed strip of loops material, whereby said outer hooks material of said at least one partial headband can be detachably secured to said circumferentially disposed strip.

15. The article of claim 1 further comprising a material strip for each of said at least one of said partial headbands having outer hooks material, said material strip having loops material on one side, whereby said strip can be detachably secured to said hooks material to form a complete headband.

16. An article of headwear comprising a front brim having rearwardly extending sides, and a rear brim having forwardly extending sides, a pair of patches of hooks material on the underside of at least a first of said brims' extending headband sides, and a pair of patches of loops material on the upper side of at least the other of said brims' extending sides, whereby said front and rear brims can be overlapped to a variable extent for size adjustment and detachably secured to one another by engagement of said patches.

17. The article of claim 16 wherein both the front portion and the rear portion have said patches of hooks material and said patches of loops material.

18. The article of claim 16 further comprising at least one partial headband from which at least one of said brims depends and outwardly extends.

* * * * *